US007515031B2

(12) United States Patent
Jakobsen et al.

(10) Patent No.: US 7,515,031 B2
(45) Date of Patent: Apr. 7, 2009

(54) UNIVERSAL FUSE ENGINE WITH MODULAR END FITTINGS

(75) Inventors: Tonni Normann Jakobsen, Heddinge (DK); Peder Knudsen, Virum (DK)

(73) Assignee: Cooper Technologies Company, Houston, TX (US)

( * ) Notice: Subject to any disclaimer, the term of this patent is extended or adjusted under 35 U.S.C. 154(b) by 329 days.

(21) Appl. No.: 11/448,256

(22) Filed: Jun. 6, 2006

(65) Prior Publication Data

US 2006/0284721 A1 Dec. 21, 2006

Related U.S. Application Data

(60) Provisional application No. 60/687,832, filed on Jun. 6, 2005.

(51) Int. Cl.
*H01H 85/20* (2006.01)
*H01H 85/02* (2006.01)

(52) U.S. Cl. ..... 337/187; 337/186; 337/248; 337/251

(58) Field of Classification Search ..... 337/186–198, 337/248, 251; 29/623
See application file for complete search history.

(56) References Cited

U.S. PATENT DOCUMENTS 1,376,342 A * 4/1921 La Mar et al. ..... 337/253
1,425,699 A * 8/1922 Maurits ..... 337/254
1,463,038 A * 7/1923 Ellison ..... 337/248
1,473,646 A * 11/1923 Sands ..... 337/237
1,542,604 A * 6/1925 Bussmann ..... 337/252
1,981,599 A * 11/1934 Kirkman ..... 337/250
2,243,135 A * 5/1941 Triplett ..... 337/291
3,118,035 A * 1/1964 Lebens ..... 337/209
3,333,685 A * 8/1967 Pezdek ..... 206/728
3,748,622 A * 7/1973 Kozacka et al. ..... 337/276
4,010,438 A * 3/1977 Scherer ..... 337/232
4,035,753 A * 7/1977 Reeder ..... 337/186
4,041,435 A * 8/1977 Gaia ..... 337/159
4,150,353 A * 4/1979 Huber et al. ..... 337/231
4,177,444 A * 12/1979 Taki ..... 337/163
4,349,803 A * 9/1982 Tobin ..... 337/186
4,613,195 A * 9/1986 Suher et al. ..... 439/166
6,147,585 A * 11/2000 Kalra et al. ..... 337/248
6,798,330 B2 * 9/2004 Arikawa et al. ..... 337/231
7,250,843 B2 * 7/2007 Richter et al. ..... 337/250

* cited by examiner

*Primary Examiner*—Anatoly Vortman
(74) *Attorney, Agent, or Firm*—Armstrong Teasdale LLP

(57) ABSTRACT

Fuse assemblies, system and kits and methods for assembling fuses include a fuse body that may be universally and interchangeably used with a plurality of different end fittings providing various fuse configurations for connection to electrical circuits. The highly adaptable fuse construction allows fuses to be manufactured and assembled using a reduced number of parts that need to be stocked in order to manufacture a complete line of fuses, and further to more quickly provide replacement fuses to customers.

42 Claims, 9 Drawing Sheets

UNIVERSAL FUSE ENGINE WITH MODULAR END FITTINGS

CROSS REFERENCE TO RELATED APPLICATIONS

This application claims the benefit of U.S. Provisional Application Ser. No. 60/687,832 filed Jun. 6, 2005, the entire disclosure of which is hereby incorporated by reference in its entirety.

BACKGROUND OF THE INVENTION

This invention relates in general to the manufacture of a line of fuses having large numbers of component parts, and more particularly to the manufacture of high speed fuses.

Fuses are widely used as overcurrent protection devices to prevent costly damage to electrical circuits. Fuse terminals typically form an electrical connection between an electrical power source and an electrical component or a combination of components arranged in an electrical circuit. A fusible link or fuse element assembly is connected between the fuse terminals, so that when electrical current flowing through the fuse exceeds a predetermined limit, the fusible link melts and opens the circuit through the fuse to prevent electrical component damage.

Many different types of fuse constructions exist, and large inventories of different types of fuses are typically required to meet a full range of circuit protection needs. It would be desirable to provide a lower cost fuse constructions and to reduce fuse inventory issues.

DETAILED DESCRIPTION OF THE INVENTION

Figure 1:
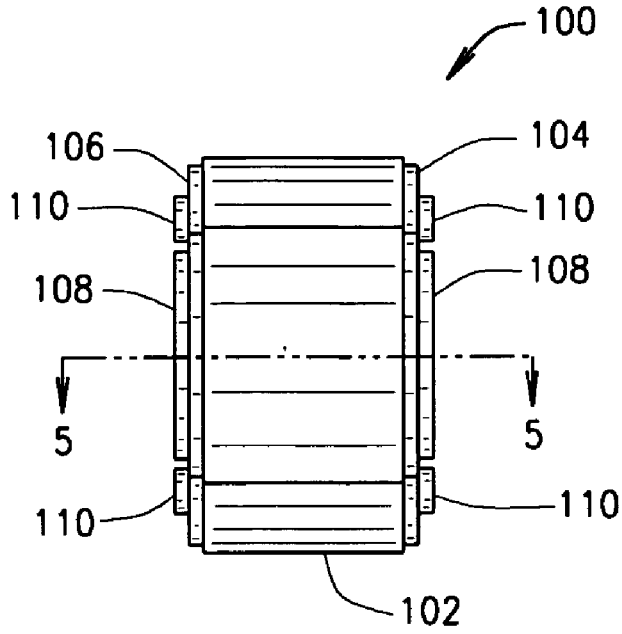
FIG. 1 is a side elevational view of an exemplary fuse engine according to the present invention at a first stage of assembly.

Embodiments of the present invention provide a relatively low cost yet highly adaptable fuse construction that may substantially reduce cost, space and complexity issues associated with having to stock and maintain large inventories of different types of fuses as has been conventionally done.

As one illustrative example, high speed fuses have been used to protect or isolate equipment having power semiconductor devices such as, for example, variable speed drives. There is very little safety factor in these semiconductor devices and they can fail quickly when subjected to overcurrents. Therefore, a fuse designed to protect semiconductor devices must open quickly. High speed fuses have very little thermal capacity, and in general open in the order of 0.001 to 0.004 seconds when interrupting short circuits.

Over time, high speed fuses have been developed to meet the needs of specific applications and devices, resulting in a large number of different fuses made in different sizes, shapes and connecting terminals to satisfy the voltage and amperage ranges expected to be encountered. Consequently, many different parts and subassemblies for these fuses, numbering in the hundreds, may be required to manufacture fuses for different customer and different applications. Maintaining an inventory stock for manufacturing a complete line of such fuses is challenging.

Typically, the fuses are completely assembled, including any terminal or connecting elements to couple the fuse to circuitry to be protected, by the manufacturer at a centralized manufacturing facility and the fuses are shipped to distributors and retailers for acquisition by customers. In part because of the large variety of such fuses, it is impractical for distributors to maintain large inventories of all the potential types of fuses. Locating a replacement fuse in an existing inventory can therefore be difficult. If it is necessary to order a replacement fuse from a manufacturer, some delay will be incurred to manufacture the fuse and and/or ship it from the manufacturer through the distribution chain to the customer. Such delay in restoring the downed circuitry and equipment is undesirable.

According to an exemplary embodiment of the invention, and as explained in detail below, a universal fuse engine is provided that is configured to accept modular end fitting elements to provide various fuse configurations. Fuses may therefore be manufactured and assembled using a reduced number of parts that need to be stocked in order to manufacture a complete line of high speed fuses, and further to more quickly provide replacement fuses to customers.

The fuse engine may be manufactured in bulk at the manufacturer level, and in an exemplary embodiment includes an insulative fuse body, conductive end closure elements coupled to the fuse body, a contact piece and a fuse element assembly. The fuse element assembly extends between one of the end closure elements and the contact piece and defines a conductive path therebetween. The fuse engine therefore includes the operative components of the fuse, and is configured to readily accept and be attached to the modular end fittings at a later stage of assembly.

One of the end closure elements and the contact piece are configured to receive separately provided modular end terminal elements. Protective elements are attachable to the respective end closure elements until the end fittings are installed. With the protective elements attached, contact portions of the end closure elements are sealed and protected from damage and environmental exposure so that the fuse engines may be shipped to another location, while reliably establishing electrical contact with the end fittings after the guards are removed and replaced with the end terminal fittings.

The modular end fittings are each provided with a standard mounting base that is compatible with the end closure element and the contact piece of the fuse engine, and a terminal element extends from the standard mounting base in each of the modular end fittings. In various embodiments, the terminal configurations may conform to various standards, requirements, and connection schemes for various applications when the end fittings are connected to fuse engines. For example, "French style" end terminals, various types of DIN end terminals, flush mount terminals, and "U.S. style" terminals may all be provided with the standard mounting base and interchangeably used with the fuse engine.

Advantageously, the modular end fittings may be stocked at the distributor level, together with an inventory of the fuse engines from the fuse manufacturer, so that the distributor may quickly assemble the end fittings to the fuse engines to quickly fill a customer order for replacement fuses. By mass producing the fuse engines and separately providing modular end fittings for installation at a later time in a non-manufacturing installation, manufacturers can reduce their parts count and associated inventory management difficulties in manufacturing fuses, while still offering a full line of fuses, and while more quickly filling customer orders and requests.

Multiple fuse engines and accompanying modular end fittings may be provided and assembled to provide fuses having varying voltage and current ratings and different dimensional package sizes.

Turning now to the Figures, FIG. 1 is a side elevational view of an exemplary fuse engine 100 according to the present invention at a first stage of assembly. As explained below, the fuse engine 100 provides a universal fuse platform or package containing the operative components of a fuse, and the engine 100 may be assembled in modular form with a variety of compatible end fittings of different types to provide a variety of fuses having different end terminal configurations. The modular end fittings may be separately provided and installed to the fuse engine 100 at a later stage of manufacture. With the engine 100 fabricated from a standard set of parts, and the modular end fittings that can be assembled thereto, manufacturers and distributors can reduce their parts count and associated inventory management difficulties while still providing a complete line of fuses, and while delivering replacement fuses to customers with minimal delay.

While the invention is believed to be particularly advantageous for the manufacture of high speed fuses, which until now have required a large number of parts to provide a full line of fuses, it is understood that other types of fuses could benefit from the principles of the present invention, and the following description is therefore provided for illustrative purposes only.

In an exemplary embodiment, the fuse engine 100 may include a nonconductive fuse body 102, conductive end closure elements 104 and 106 coupled to opposing ends of the fuse body 102, and protective elements or guards 108 attached to the end closure elements 104 and 106. The fuse engine 100 may be assembled by the manufacturer and shipped to a non-manufacturing site to be completely assembled for use in a circuit having, for example, semiconductor components that are sensitive to overcurrent conditions. Fuses may therefore be manufactured and assembled at different times and locations using a reduced number of parts that need to be stocked in order to manufacture a complete line of high speed fuses, and further to more quickly provide replacement fuses to customers.

The fuse body 102 in an illustrative embodiment may be manufactured into a generally square configuration having rounded corners, although it is appreciated that the body 102 could be fabricated into other shapes in alternative embodiments of the invention. The body 102 defines a cavity or opening therein (shown in FIG. 5 with reference number 202) which houses a known fuse element assembly (shown in phantom in FIG. 5 with element 200). The body 102 includes opposite ends that are open or in fluid communication with the cavity 202, and the end closure elements 104, 106 are attached to the ends of the body 102. The end closure elements 104, 106, in one embodiment, may be conductive plates attached to the body 102 of the engine 100 via known fasteners 110 such as screws, rivets or other fasteners or fastening methods known in the art The guards 108 may be removably attached to the closure elements 104, 106 as described below, and are in abutting contact with outer surfaces of the end closure elements 104, 106 to protect contact portions of the closure elements, as explained below, for shipping and transit from a manufacturer, for example, to a distributor.

Figure 2:
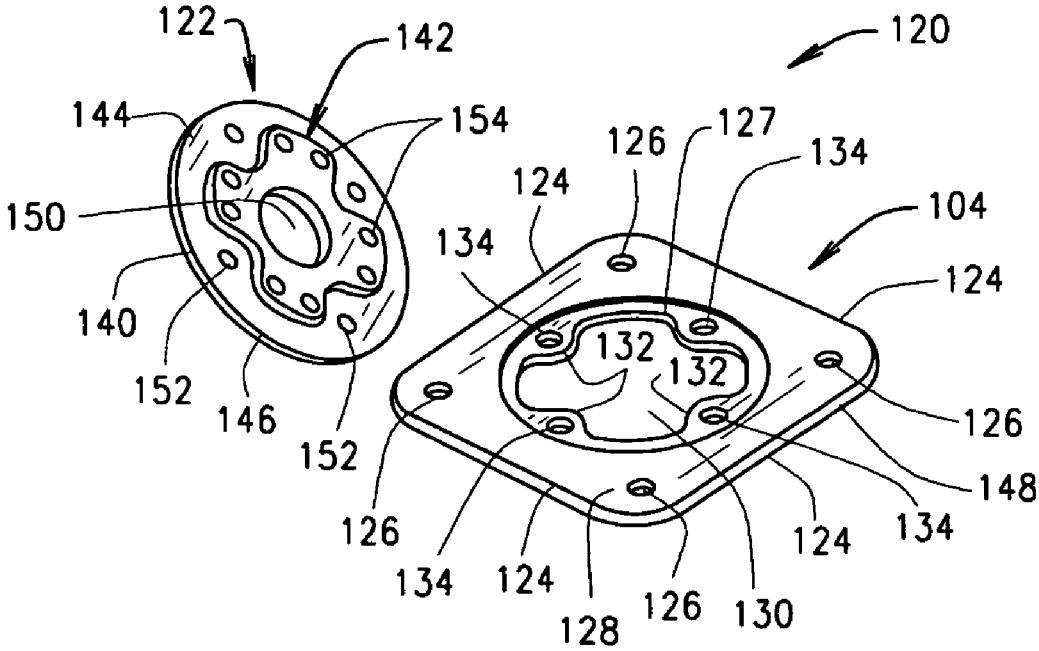
FIG. 2 is a perspective view of a first exemplary end closure assembly for the fuse engine shown in FIG. 1.

FIG. 2 is a perspective view of one end closure assembly 120 for the fuse engine 100 (FIG. 1) including the end plate 104 and a contact piece 122. As depicted in FIG. 2, the end plate 104 in one example includes exterior end edges 124 generally defining a square shape with rounded corners, and hence an outer periphery of the plate 104 corresponds to the general shape of the fuse body 102 (FIG. 1). While a square or rectangular shape is illustrated in FIG. 2, it is understood that the end plate 104 may be alternatively shaped in another embodiment of the invention, including but not limited to a circular shape complementary to a cylindrical fuse body.

Body mounting apertures 126 are provided in the end plate 104 adjacent the corners thereof to secure the end plate 104 to one end of the fuse body 102, and the apertures 126 may be threaded to receive fasteners (not shown in FIG. 2). A central recessed area 127 may be provided in the middle of the end plate 104, and may define, for example, a circular contact area that is depressed relative to the top surface 128 of the plate 104 adjacent the end edges 124. A contoured central opening 130 may be provided in the recessed area 127, and as shown in FIG. 2, the central opening 130 may have a clover leaf shape in an exemplary embodiment.

When the end plate 104 is attached to the body 102 (FIG. 1), the opening 130 exposes a portion of the cavity 202 (FIG. 5) on one end thereof, and provides for fluid communication with an interior of the cavity 202 as explained hereinbelow. Mounting lugs 132 extend inwardly toward the center of the opening 130, and each mounting lug 132 includes a contact piece mounting aperture 134 to attach the contact piece 122 to the end plate 104. The apertures 134 may be threaded to receive fasteners.

The contact piece 122 may be fabricated in an exemplary embodiment into an annular or disk shape having a round flange portion 140 and an inset mating portion 142 extending from the flange portion 140. The mating portion 142 may be raised or elevated from the top surface 144 of the flange portion 140, and the mating portion includes an outer periphery 146 having a clover leaf shape that is complementary to, but slightly smaller than, the shape of the central opening 130 of the end plate 104. The mating portion 142 of the contact piece 122 may therefore be inserted into the central opening 130 of the end plate 104 with the flange portion 140 of the contact piece abutting an underside 148 of the end plate 104.

A round central opening 150 extends through each of the mating portion 142 and the flange portion 140 of the contact piece 122.

While a disk shaped contact piece 122 is illustrated in FIG. 2, it is understood that other geometric shapes of the contact piece may likewise be employed in other embodiments of the invention.

The flange portion 140 of the contact piece 122 may include end plate mounting apertures 152 for attaching the contact piece 122 to the end plate 104, and the apertures 152 may be threaded to receive fasteners. When the contact piece 122 is assembled to the end plate 104, the end plate mounting apertures 152 align with the contact piece mounting apertures 134 of the end plate 104. The mating portion 142 of the contact piece 122 may further include pairs of end fitting mounting apertures 154 for attachment of an end fitting, described below, to the contact piece 122. The end fitting mounting apertures 154 may be threaded to receive fasteners.

Figure 3:
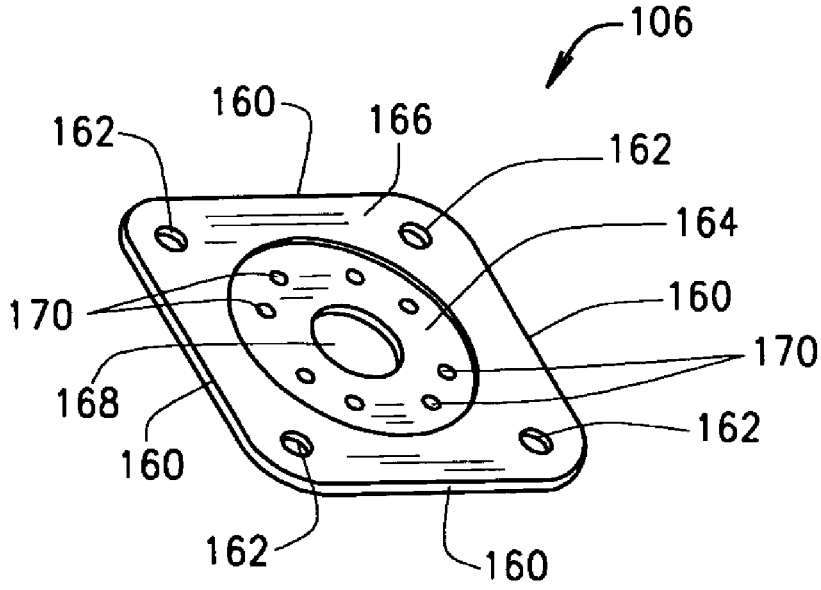
FIG. 3 is a perspective view of a second exemplary end closure assembly for the fuse engine shown in FIG. 1.

FIG. 3 illustrates the end plate 106 for the fuse engine 100 (FIG. 1). As depicted in FIG. 3, the end plate 106 may includes exterior end edges 160 generally defining a square shape with rounded corners, and hence an outer periphery of the plate 106 corresponds to the general shape of the fuse body 102 (FIG. 1). While a square or rectangular shape is illustrated in FIG. 3, is understood that the end plate 106 may be alternatively shaped in another embodiment of the invention, including but not limited to a circular shape complementary to a cylindrical fuse body.

Body mounting apertures 162 are provided in the end plate 106 adjacent the corners thereof to secure the end plate 106 to the fuse body 102, and the apertures 162 may be threaded. A central recessed area 164 may be provided in the middle of the end plate 106, and may define, for example, a circular contact area that is depressed relative to the top surface 166 of the plate 106 adjacent the end edges 160.

Unlike the end plate 104 (FIG. 2), the end plate 106 includes a round central opening 168 therein. When the end plate 106 is attached to the body 102 (FIG. 1), the opening 168 exposes a portion of the cavity 202 (FIG. 5) on one end thereof, and provides for fluid communication with an interior of the cavity 202 as explained hereinbelow. Pairs of end fitting mounting apertures 170 are provided adjacent the periphery of the central opening 168 to attach an end fitting, explained below, to the end plate 106. The apertures 170 may be threaded as desired.

While the embodiment described thus far includes the end closure assembly 120 on one side of the fuse engine 100 and the end plate 106 on the other side of the fuse engine 100, it is contemplated that in other embodiments the end closure assembly 120, or alternatively the end plate 106, may be used on both sides of the fuse engine 100 while still achieving the benefits of the invention.

Figure 4:
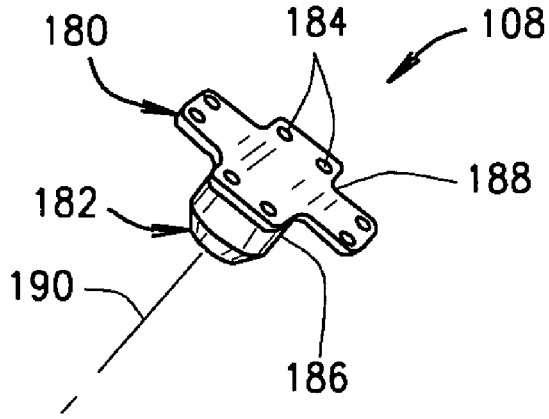
FIG. 4 is a perspective view of an exemplary protective element for the end closure elements shown in FIGS. 2 and 3.

FIG. 4 is a perspective view of an exemplary guard 108 for the engine 100 (FIG. 1). The guard 108 may include a flange portion 180 and a plug portion 182 extending from the flange portion 180. The flange portion 180 in an exemplary embodiment is complementary in shape to the contoured central opening 130 (FIG. 2) of the end plate 104, and the flange portion 180 includes mounting apertures 184 that align with the end fitting mounting apertures 154 of the contact piece 122 (FIG. 2) or the end fitting mounting apertures 170 of the end plate 106 (FIG. 3). The apertures 184 may be threaded and joined to the apertures 154 with a fastener.

The plug portion 182 may extend generally perpendicular to the flange portion 180 and may include an outer diameter that is dimensioned for insertion into the central opening 150 of the contact piece 122 (FIG. 2) or the central opening 168 of the end plate 106 (FIG. 3). The guard 108 may further include a channel or flow path 186 extending through a top surface 188 of the flange portion 180 and extending partially along a longitudinal axis 190 of the plug portion 182. The guard 108 may be fabricated from a nonconductive material, such as plastic, or other known materials in the art according to known techniques.

Figure 5:
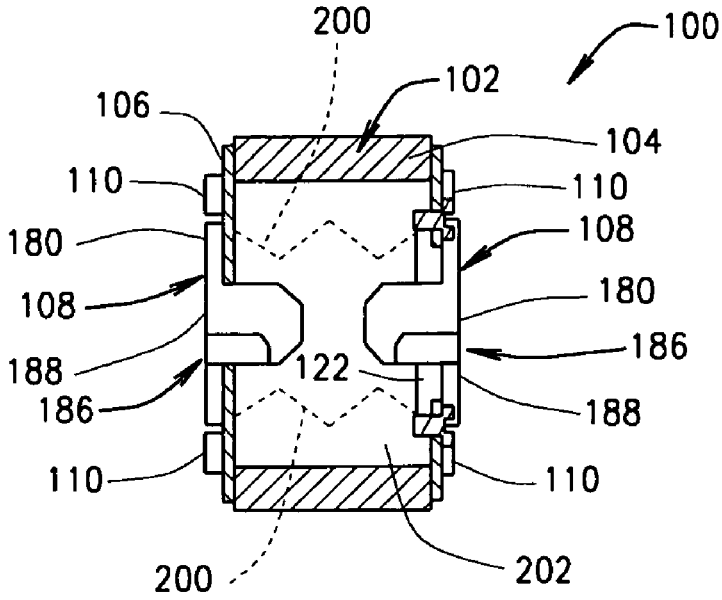
FIG. 5 is a cross sectional view of the fuse engine taken along the line 5-5 of FIG. 1.

FIG. 5 is a cross sectional view of the fuse engine 100 taken along the line 5-5 of FIG. 1 with the end plates 104, 106 attached to the fuse body 102 via the fasteners 110. The contact piece 122 is coupled behind and in contact with the end plate 104. Fuse elements 200 (shown in phantom in FIG. 5) are located in a cavity 202 defined by the fuse body 102, and the fuse elements 200 are electrically connected between the end plate 106 on one side of the fuse body 102, and the contact piece 122 on the opposite side of the fuse body 102 via, for example, known welding, brazing or soldering techniques. In accordance with known fuse elements, the fuse elements 200 may include areas of reduced cross sectional area, sometimes referred to as weak spots, that are dimensioned to melt, vaporize, disintegrate, open or otherwise destruct the current path through the fuse elements 200 when predetermined overcurrent conditions occur, thereby isolating load side equipment including semiconductor devices, such as variable speed drives in one application, from damaging overcurrent conditions. The fuse elements may be of a standardized planar design using a corrugated or accordion shape which allows for the use of an element having a substantially longer overall effective length than can be achieved with a straight or linear element. The increase in effective length enhances the ability of the fuse element to clear lower level overcurrent situations, especially in DC circuits. While multiple fuse elements 200 are illustrated in FIG. 5, it is recognized that the invention could be practiced with a single fuse element.

The guards 108 may be coupled to the end plate 106 and the contact piece 122, respectively. The flange portions 180 of the guards 108 are in abutting surface engagement with the recessed area 164 (FIG. 3) of the end plate 106, and the mating portion 142 (FIG. 2) of the contact piece 122. The channel 186 in each guard 108 may be accessible through the top surface 188 of the flange portion 180 of each guard 108, and the channels 186 may extend into an interior of the cavity 202 defined by the fuse body 102. The channels 186 define flow paths on each side of the fuse body 102 for the introduction of an arc-quenching media, such as silica or another material, from the exterior of the cavity 202 into the interior of the fuse body cavity 202. It is understood, however, that a channel 186 could be provided on only one side of the fuse body 102, and that alternatively more than one channel could provided on one or both sides of the fuse body 102 in other embodiments.

The arc quenching material surrounds the fusible elements 200 in the cavity 202, and in one embodiment is solidified or cured to a solid form according to known techniques, such as a silication technique. The channels 186 in the guards are plugged or blocked after the arc quenching media is introduced.

Figure 6:
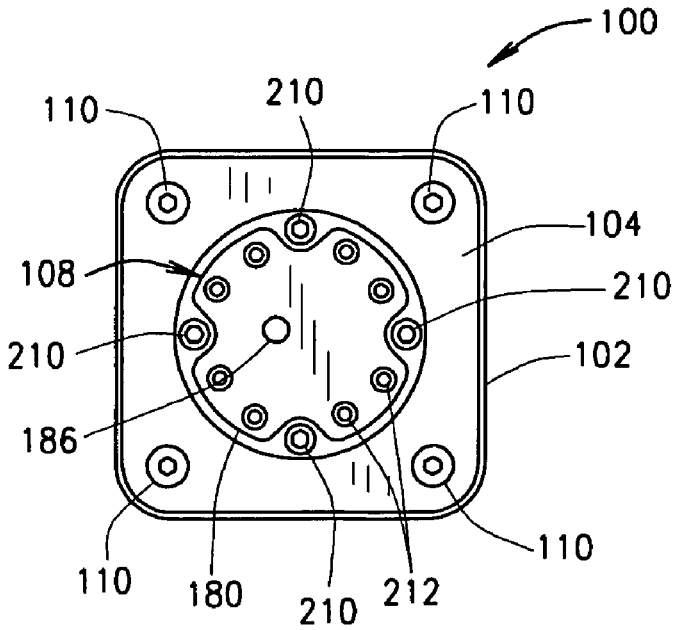
FIGS. 6 and 7 are end views of the fuse engine shown in FIG. 1.
Figure 7:
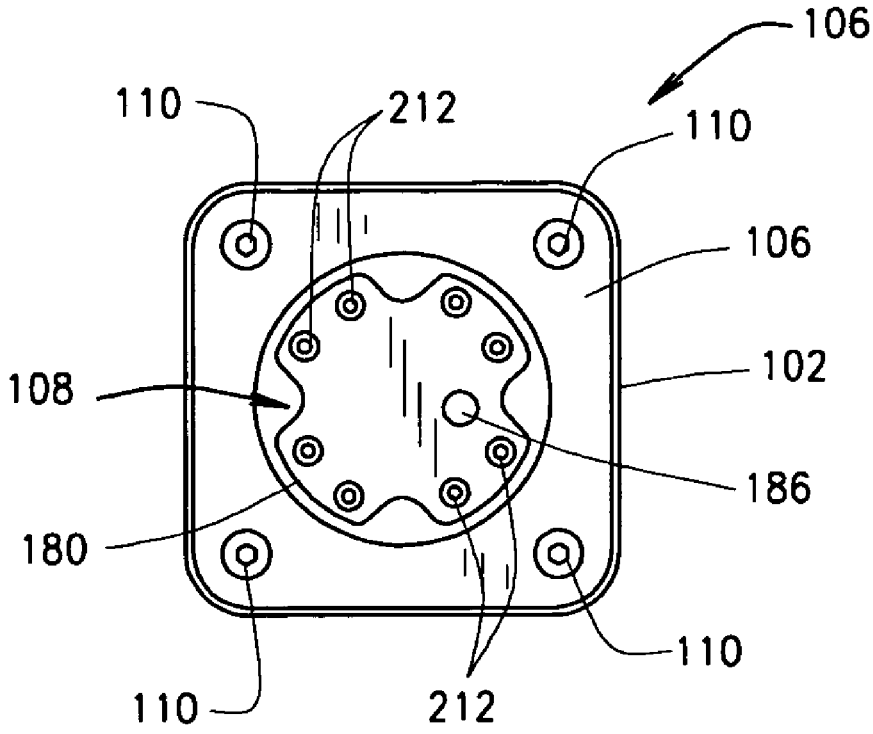

FIGS. 6 and 7 are end views of the fuse engine 100 shown in FIG. 1 with the end plates 104, 106 attached to the fuse body 102 with the fasteners 110. The contact piece 122 (FIGS. 2 and 5) is coupled to end plate 104 via the apertures 134 and 152 (FIG. 2) with fasteners 210, such as screws, rivets or other fasteners or fastening techniques known in the art. The guards 108 are removably coupled to the contact piece 122 with fasteners 212 via the apertures 170 (FIG. 3) in the end plate 106 and the apertures 154 (FIG. 2) in the contact piece 122. The fasteners 212 may be tightened to provide a clamping force upon the recessed area 164 (FIG. 3) of the end plate 106 and the mating portion 142 (FIG. 2) of the contact piece 122 to protect the corresponding areas from damage and to keep the surfaces clean during shipping and transit. The channels 186 are accessible from an exterior of the cavity 202 (FIG. 5) for introduction of the arc quenching media after the guards 108 are attached to the engine 100. The fasteners 212 may be installed prior to introduction of the arc quenching media, and because the fasteners occupy the mounting apertures 170 in the end plate 106 and the apertures 154 in the contact piece 122, the arc quenching media is prevented from entering the mounting apertures. Thus, when the guards 108 are removed from the engine 100 for installation of the end fittings, the mounting apertures will not be adversely affected by the arc quenching media.

Figure 8:
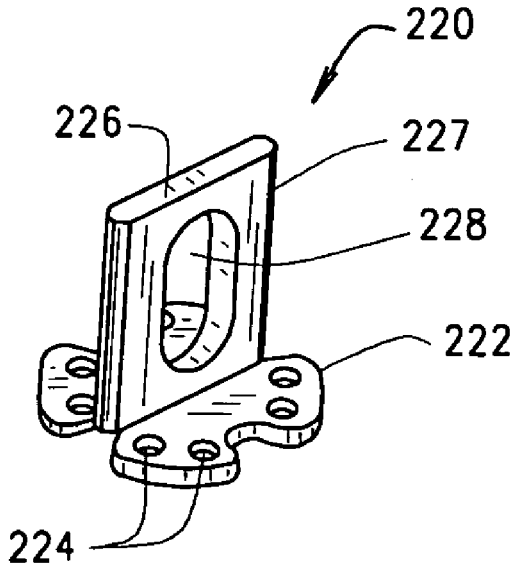
FIG. 8 is a perspective view of an exemplary modular end fitting for use with the fuse engine shown in FIG. 1.

FIG. 8 is a perspective view of an exemplary modular end fitting 220 for use with the fuse engine 100 after the guards 108 are removed. The end fitting 220 may include a mounting base 222 having the same general shape as the flange portion 180 of the guards 108 as best seen in FIGS. 6 and 7. That is, in the illustrated embodiment, the mounting base 222 has a clover leaf shape and corresponding mounting apertures 224 extending therethrough that align with the mounting apertures 170 in the end plate 106 and the apertures 154 in the contact piece 122 of the fuse engine 100, as described above.

The end fitting 220 may further include an end terminal portion 226 extending upwardly and away from the mounting base 222. The end terminal portion 226 is configured for connection to terminals of circuitry to be protected, and as shown in FIG. 8, the terminal portion 226 includes a blade contact 227 having an oblong aperture 228 therethrough, as is commonly found in known fuse terminals employed in the United States. Thus, the end terminal 226 is sometimes referred to as a "U.S. style" terminal.

Figure 9:
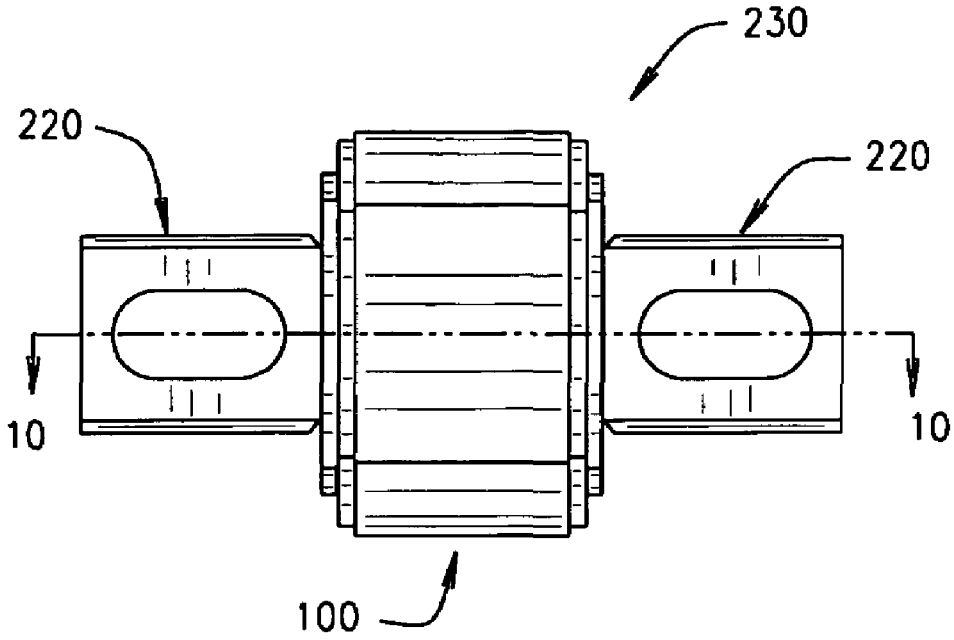
FIG. 9 is a side elevational view of a fuse including the fuse engine at a second stage of assembly including modular end fittings.

FIG. 9 illustrates the end fittings 220 coupled to either side of the fuse engine 100 after the guards 108 have been removed from the fuse engine 100, thereby forming a complete fuse assembly 230 that may be connected to circuitry.

Figure 10:
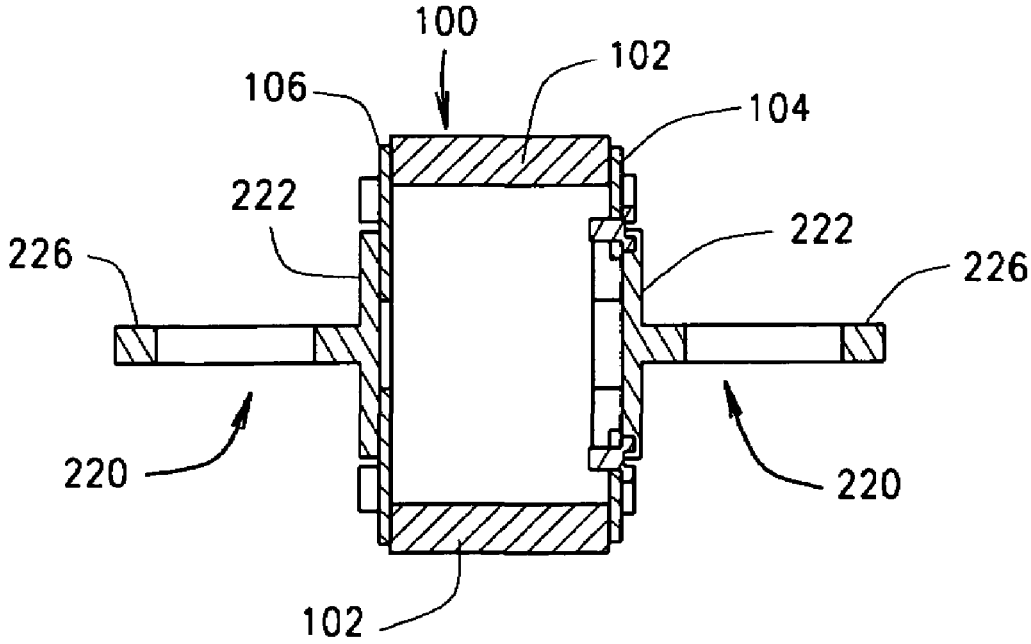
FIG. 10 is a side elevational view of the fuse engine, taken along line 10-10 of FIG. 9, with the modular end fittings installed.

FIG. 10 is a cross sectional view of the fuse assembly 230, taken along line 10-10 of FIG. 9, wherein it is seen that the mounting bases 222 of the respective end fittings 220 occupy the position of the guards 108 prior to their removal from the fuse engine 100.

Figure 11:
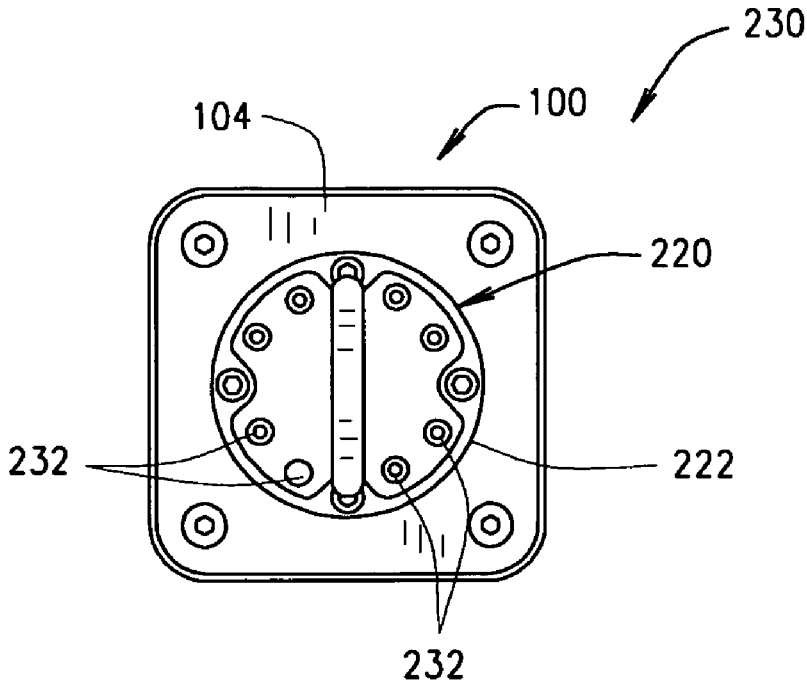
FIGS. 11 and 12 are end views of the fuse shown in FIG. 9.
Figure 12:
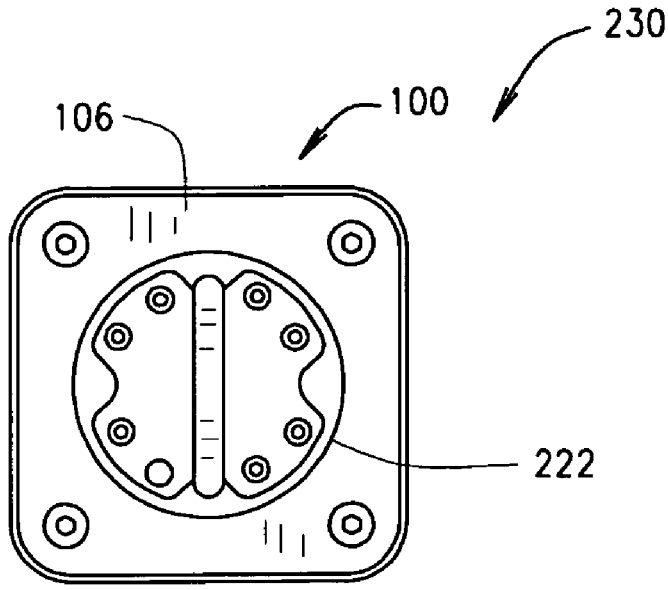

FIGS. 11 and 12 are end views of the fuse assembly 230 illustrating the end fittings 220 attached to the fuse engine 100 via the mounting bases 222. Fasteners 232 couple the mounting bases 222 to the end plate 104 and the contact piece 122 in the same manner as the guards were attached, and the fasteners 232 may be the same or different fasteners as the guard fasteners 212 shown in FIGS. 6 and 7.

Figure 13:
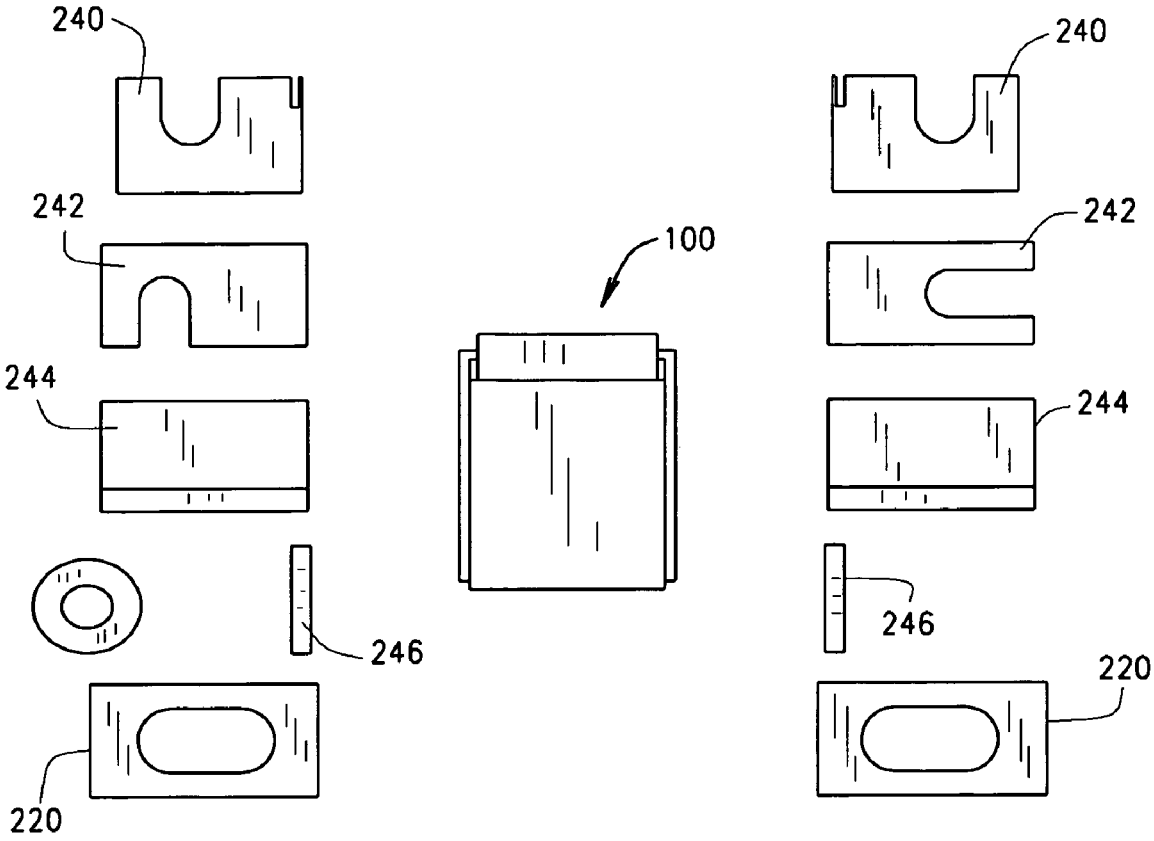
FIG. 13 illustrates various embodiments of modular end terminal fittings which may be used with a fuse engine of the present invention.
Figure 14:
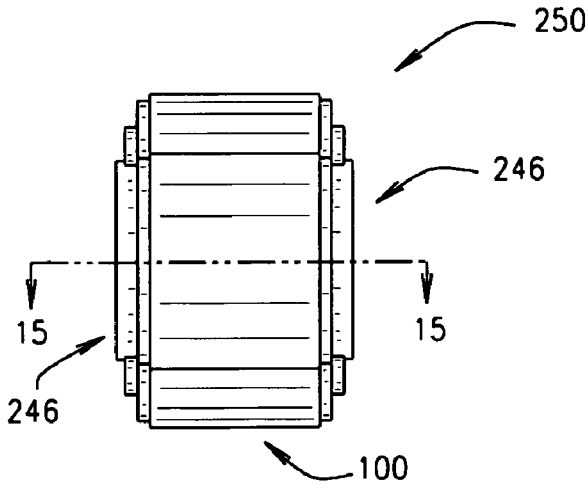
FIG. 14 illustrates another exemplary embodiment of a fuse including a fuse engine and modular end fittings according to the present invention.
Figure 15:
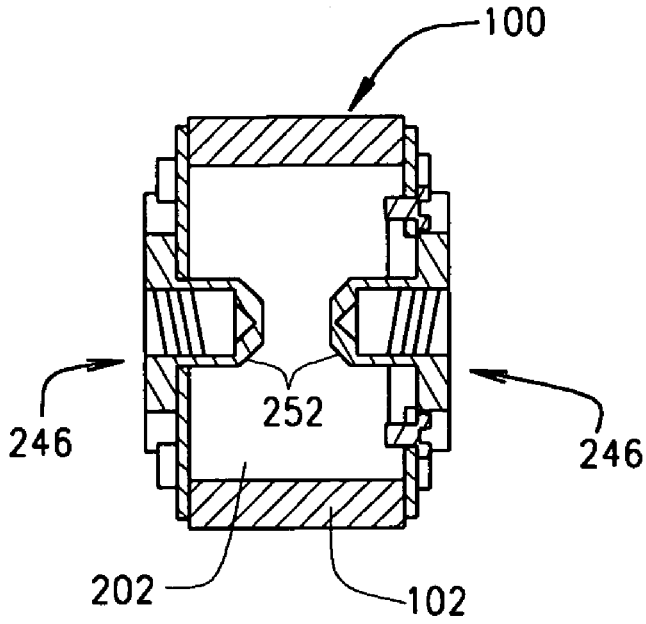
FIG. 15 is a side elevational view of the fuse engine, taken along line 15-15 of FIG. 14, with modular end fittings installed.
Figure 16:
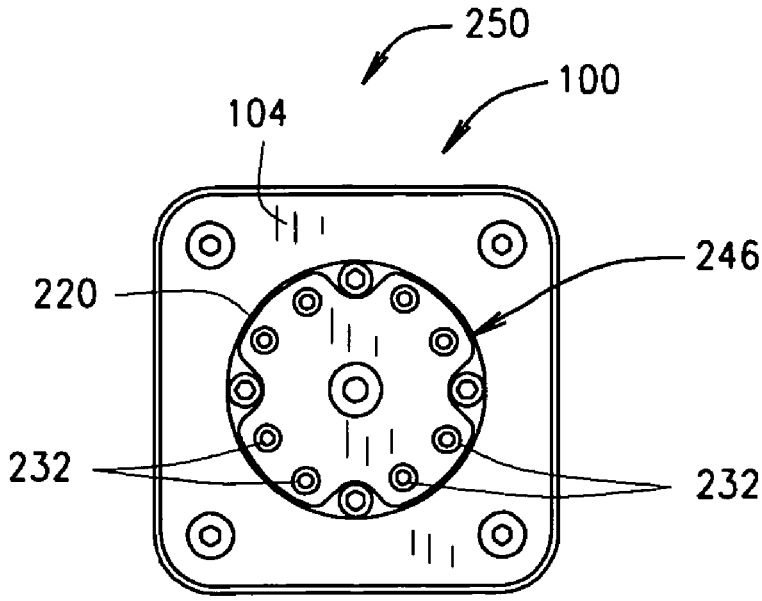
FIGS. 16 and 17 are end views of the fuse shown in FIG. 14.
Figure 17:
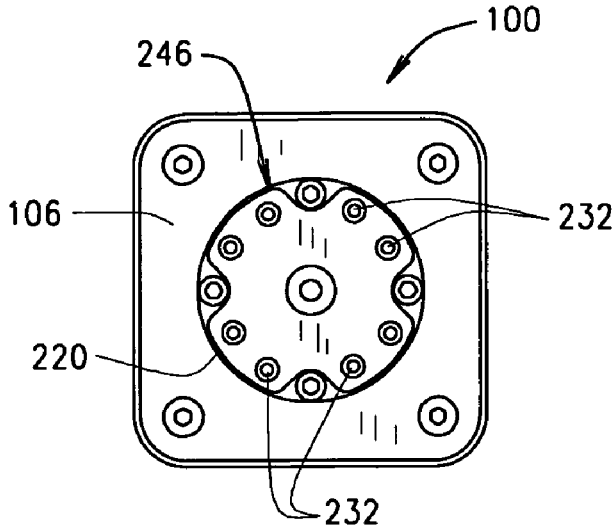

FIG. 13 illustrates various embodiments of modular end terminal fittings which may be used with the fuse engine 100, including the "U.S. style" terminal fitting 220. Additionally, "French style" end fittings 240 may be provided, DIN 43653 end fittings 242 may be provided, DIN 43620 end fittings 244 may be provided, and flush mount end fittings 246 may be provided, all of which include the same mounting base 222 shown in FIGS. 9-12. The "French style" end fittings include mirror image blade contacts with U-shaped openings on one edge thereof as shown in FIG. 13. The DIN 43563 end fittings include blade contacts having respective U-shaped openings oriented at approximately 90° angles to one another as known in the art. The DIN 43620 end fittings include solid contact blades known in the art. The flush mount fittings are generally annular. Each end fitting style, however, is provided with the mounting base 222.

As such, the mounting base 222 is sometimes referred to as a standard base, and the end fittings 220, 240, 242, 244, and 246 including the standard base 222 are therefore interchangeably used with one another on the fuse engine 100 to assemble a variety of fuses having different end terminal configurations. While some exemplary end terminal configurations are shown in FIG. 13, the configurations depicted therein are only some potential end fitting configurations that could be used. It is anticipated that other modular end fittings having other end terminal configurations will be desirable and advantageously used with the present invention.

With the engine 100 fabricated from a standard set of parts, and the modular end fittings 220 that can be assembled thereto, manufacturers can reduce their parts count and associated inventory management difficulties while still providing a complete line of fuses, and while delivering replacement fuses with minimal delay. Fuses may therefore be manufactured and assembled at different times and locations using the modular end fittings 220 and the modular fuse engine platform. The universal fuse engines 100 and the modular end fittings 220 may be supplied in kits for ready assembly to meet needs as they arise.

Multiple fuse engines and accompanying modular end fittings may be provided and assembled to provide fuses having varying voltage and current ratings and different dimensional package sizes.

By way of example, FIGS. 14-17 illustrate the flush mount end fittings 246 coupled to the fuse engine 100 to provide another fuse assembly 250 for connection to circuitry to be protected. The end fittings 246 include the mounting base 222 and a screw terminal coupler 252 extending interior to the cavity 202 of the fuse body 102. Fasteners 232 couple the end fittings 246 to the fuse engine in the same manner as the guards were attached, and the fasteners 232 may be the same or different fasteners as the guard fasteners 212 shown in FIGS. 6 and 7.

Having now described some exemplary embodiments of the fuse engine and modular end fittings with standardized mounting bases, it is believed that the versatility of the invention has now been demonstrated and the advantages of the invention are now apparent. Furthermore, the methodology of the present invention could be applied beyond the application of high speed fuses as herein presented.

Figure 18:
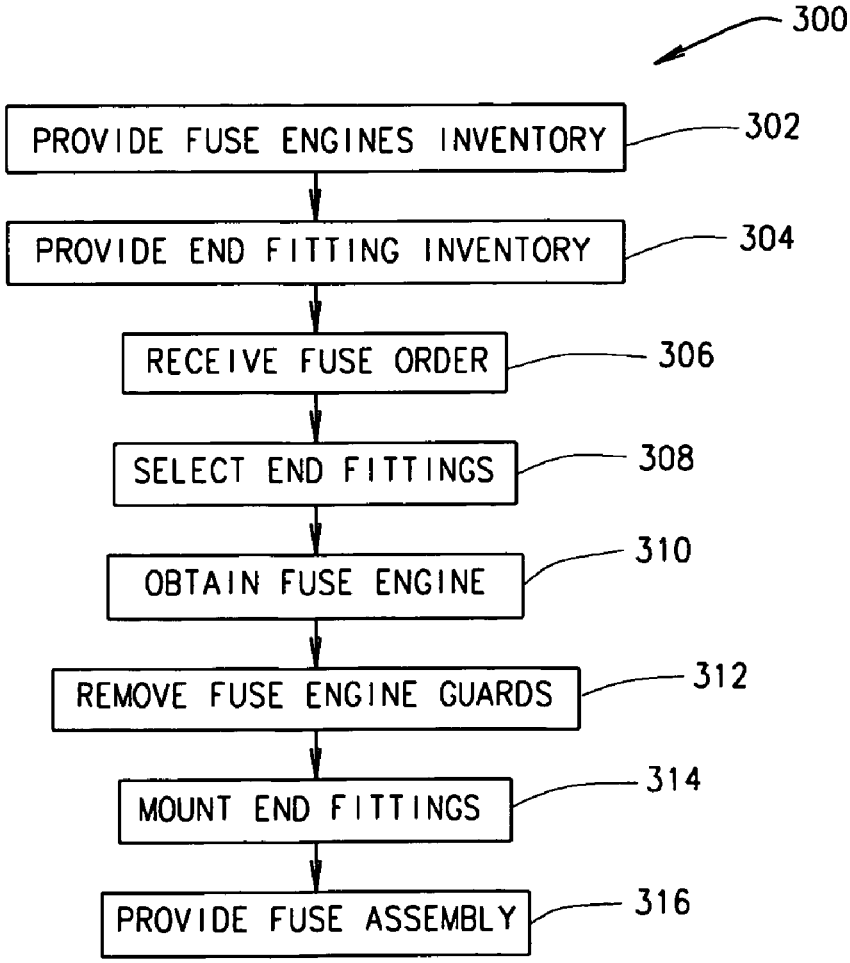
FIG. 18 is a flowchart of a method of assembling fuses according to the present invention.

FIG. 18 illustrates an exemplary method 300 of assembling and providing fuses according to the present invention. The method includes providing 302 and maintaining an inventory of universal fuse engines with removable guards attached to the end closure elements for shipping and transit as described above. As used herein, "inventory" shall mean one or more fuse engines that are similarly or identically constructed to one another such as the engine 100 described above. More than one type of fuse engine may be provided and inventoried for an expanded offering of potential fuse products. That is, fuse engines having different sizes and shapes, fuse elements of different ratings or operating characteristics, etc. may be provided.

An inventory of modular end fittings of different types or styles is also provided and maintained 304 that may be used in combination with the inventory of fuse engines in an interchangeable manner as described above. As used herein, "inventory" shall include one or more sets of modular end fittings, and preferably multiple sets of different styles of fittings. The number of end fitting sets in the end fitting inventory may be the same or different from the number of fuse engines in the fuse engine inventory. The inventory of end fitting may include, without limitation, any of the aforementioned end terminal configurations and other terminal configurations as desired. The fuse engine inventories and the end fitting inventories may be fabricated, provided and inventoried in the same or different location.

When an order for a fuse is received 306 from a customer or other party, either for an original fuse or for a replacement fuse, appropriate end fittings are selected 308 from the end fitting inventory of step 304 to fill or satisfy the order. Orders may be received in any manner, from human entry to automated systems known in the art, and the selection 308 is made from the available types and styles of end fittings of different configurations, which as described above includes exemplary styles of selected from the group of a French style fitting, a DIN style fitting, a flush mount fitting, a US style fitting, or other types of fittings and combinations of fittings as desired. The selection 308 may be made automatically or manually in different embodiments.

After selecting 308 the appropriate end fittings for a customer order, a fuse engine is obtained 310 from the inventory 302 and the guards are removed 312 to expose the contact areas of the fuse engine described above, which are kept clean and protected during shipping and handling of the engine. The guards may be removed 312 at a location separate, such as a distribution facility, from a manufacturing facility for the fuse engine. The guards may be removed in an automated manner or in a manual manner.

Once the guards are removed 312, the selected end fittings may be mounted 314 to the fuse engine in mating contact with the clean contact areas protected by the guards prior to their removal. When the end fittings are mounted 314 to the engine, a fuse assembly ready for connection to a circuit is provided 316 to the customer for use.

The method 300 provides for assembly of a variety of fuses with different terminal structures from a relatively small number of parts. That is, each of the fuse engine inventory and the end fitting inventory may be relatively small, while meeting a relatively large number of different customer orders for different types of fuses in relatively little time in comparison to known fuses and conventional construction and assembly methods of fuses. Because all of the end fittings are installed in the same way by virtue of the standard mounting base, the fuse assemblies of different types may be installed with equal ease and speed, and fuse assemblies from the inventoried components can be provided in a matter of minutes.

Further, the inventories of fuse engines and end fittings may be optimized to meet anticipated needs while minimizing the amounts of components actually inventoried. For example, certain types of end fittings that are frequently ordered may be maintained in a larger inventory than other types of end fittings that are less frequently ordered.

As embodiment of a fuse assembly is disclosed herein that comprises a fuse body defining a cavity and a first end in fluid communication with the cavity. A first end closure element is coupled to the first end of the fuse body, and the first end closure element comprising an opening exposing a portion of the first end. At least one fuse element is situated in the cavity, and a removable guard substantially closing the opening for shipping and transit of the fuse assembly.

Optionally, the first end closure may comprise an end plate. The fuse body may be generally square. The guard may include a plug portion extending through the opening and extending inwardly into the cavity, and the guard may include a channel defining a flowpath extending from an exterior of the cavity to the interior of the cavity. A contact piece may be separately provided from the first end closure element and may be attached to the first end closure element. The at least one fuse element may be electrically connected to the contact piece The opening in the end closure element may be non-circular, and may have a clover leaf shape. A plurality of modular end fittings of different types may be separately provided from the first end closure element, with each of the modular end fittings configured to connect to the fuse assembly when the guard is removed. The end fittings may be selected from the group of a French style fitting, a DIN style fitting, a flush mount fitting, a US style fitting, and combinations thereof. The modular end fittings may comprise a base portion and a terminal portion, with the base portions of the modular end fittings configured for interchangeable mounting of the modular end fittings to the first end closure element.

Another embodiment of a fuse assembly is also disclosed. The assembly comprises a fuse body defining a cavity and opposite ends in fluid communication with the cavity. First and second end closure elements are coupled to the first end of the fuse body, with each of the first and second end closure elements comprising a central opening extending therethrough and exposing a portion of cavity. At least one fuse element is situated in the cavity and electrically connected to one of the first and second end closure elements, and first and second removable guards extend over each respective central opening in the first and second end closure elements.

Optionally one of the first and second end closure elements comprises a plate, and one of the first and second end closure elements may comprise a recessed contact area surrounding the central opening. One of the guards may include a flange portion and a plug portion extending inwardly into the cavity, with the flange portion having a shape complementary to the central opening. One of the guards may include a channel defining a flowpath extending from an exterior of the cavity to the interior of the cavity. An optional contact piece may be coupled to one of the end closure elements, the contact piece defining a contact area, and one of the first and second removable guards covering the contact area.

An embodiment of a fuse assembly is disclosed wherein a fuse body defines a cavity and opposite ends in fluid communication with the cavity. First and second end closure elements are coupled to the first end of the fuse body, with each of the first and second end closure elements comprising a central opening extending therethrough and exposing a portion of cavity. The central openings of the first and second end closure elements are different from one another, and a contact piece is coupled to the first end closure element. The contact piece has a flange portion and a mating portion, the mating portion having a complementary shape to the central opening of the first end closure element and being insertable therein. At least one fuse element is situated in the cavity, the fuse element having first and second ends, and the fuse element electrically connected to the contact piece at the first and to the second end closure element at the second end. A plurality of interchangeable modular end fittings of different types are provided, and each of the modular end fittings configured to be interchangeably mounted to one of the contact piece and the second end closure element.

Optionally, first and second removable guards extend over each respective central opening in the first and second end closure elements. One of the first and second end closure elements may comprise a recessed contact surface, the assembly further comprising a guard comprising a flange portion and a plug portion, the flange portion in abutting contact with the recessed contact surface. A removable guard may be in abutting contact with one of the first and second end closure elements, the guard defining a flowpath extending from an exterior of the cavity to the interior of the cavity.

A kit for assembling a fuse is also disclosed. The kit comprises a universal fuse engine comprising a body, a fuse element within the body, and end terminal end closure elements; and a plurality of interchangeable end fittings mountable to the universal fuse engine, the plurality of end fittings comprising different terminal configurations extending from a standard mounting base compatible with the universal fuse engine.

Optionally, the fuse engine may comprise a high speed fuse element. The standard mounting base may be non-circular, and may be clover shaped. Guards may be provided and configured to removably engage the fuse engine prior to installation of the modular end fittings The universal fuse engine may comprise opposite end closure elements coupled to the body and a contact piece, with the fuse element extending between one of the end closure elements and the contact piece.

A method of assembling a fuse from an inventory of components including at least one universal fuse engine and a plurality of separately provided modular end fittings of different configurations is disclosed. The universal fuse engine may be provided with removable guards attached to end closure elements, and the method comprises removing the guards from the fuse engine; selecting a first and second end fitting from the plurality of modular end fittings of different configurations; and mounting the first and second end fittings to the fuse engine where the guards were installed prior to removal.

Optionally, selecting the first and second end fittings comprises selecting the first and second end fittings from the group of a French style fitting, a DIN style fitting, a flush mount fitting, a US style fitting, and combinations thereof. Removing the guards may comprise removing the guards at a location separate from a manufacturing facility for the fuse engine. The method may further comprise maintaining an inventory of substantially identical universal fuse engines; maintaining an inventory of the modular end fittings; receiving a customer order for a replacement fuse; selecting the first and second end fittings to fill the order; and providing one of the universal fuse engines and the selected modular end fittings to the customer.

A modular fuse system is also disclosed, the system comprising: a plurality of modular end fittings having modular end fittings with a standard mounting base and various terminal configurations; and a universal fuse engine, separately provided from the modular end fittings, configured to accept any of the modular end fittings via the standard mounting bases thereof.

Optionally, the universal fuse engine comprises a body, a fuse element within the body, and end closure elements, wherein the mounting bases are attachable to the end closure elements. The universal fuse engine may include a high speed fuse element.

A modular fuse system is also disclosed. The system comprises means for packaging operative components of a fuse into a stand alone assembly for shipping and transit. A means for connecting the means for packaging to a circuit is also provided. The means for connecting provides a variety of connecting options for the means for packaging, and the means for connecting is separately provided from the means for packaging. The means for connecting is interchangeably used with the means for packaging.

While the invention has been described in terms of various specific embodiments, those skilled in the art will recognize that the invention can be practiced with modification within the spirit and scope of the claims.

What is claimed is:

1. A fuse-assembly comprising:

a fuse body defining a cavity and a first end in fluid communication with the cavity;

a first end closure element coupled to the first end of the fuse body, the first end closure element comprising an opening exposing a portion of the first end;

at least one fuse element situated in the cavity; and a non-conductive removable guard substantially closing the opening for shipping and transit of the fuse assembly.

2. The fuse assembly of claim 1, wherein the first end closure comprises an end plate.

3. The fuse assembly of claim 1, wherein the fuse body is generally square.

4. The fuse assembly of claim 1, further comprising a contact piece, the contact piece separately provided from the first end closure element.

5. The fuse assembly of claim 1, further comprising a contact piece attached to the first end closure element, the at least one fuse element electrically connected to the contact piece.

6. The fuse assembly of claim 1, wherein the opening is non-circular.

7. The fuse assembly of claim 1, wherein the opening has a clover leaf shape.

8. The fuse assembly of claim 1, further comprising a plurality of modular end fittings of different types, the modular end fittings being separately provided from the first end closure element, each of the modular end fittings configured to connect to the fuse assembly when the guard is removed.

9. The fuse assembly of claim 8, wherein the plurality of modular end fittings are selected from the group of a French style fitting, a DIN style fitting, a flush mount fitting, a US style fitting, and combinations thereof.

10. The fuse assembly of claim 1, further comprising a plurality of modular end fittings of different types, wherein each of the modular end fittings comprises a base portion and a terminal portion, the base portions of the modular end fittings configured for interchangeable mounting of the modular end fittings to the first end closure element.

11. A fuse assembly comprising:

a fuse body defining a cavity and a first end in fluid communication with the cavity;

a first end closure element coupled to the first end of the fuse body, the first end closure element comprising an opening exposing a portion of the first end;

at least one fuse element situated in the cavity; and a removable guard substantially closing the opening for shipping and transit of the fuse assembly;

wherein the guard includes a plug portion extending through the opening and extending inwardly into the cavity.

12. A fuse assembly comprising:

a fuse body defining a cavity and a first end in fluid communication with the cavity;

a first end closure element coupled to the first end of the fuse body, the first end closure element comprising an opening exposing a portion of the first end;

at least one fuse element situated in the cavity; and a removable guard substantially closing the opening for shipping and transit of the fuse assembly;

wherein the guard includes a channel defining a flowpath extending from an exterior of the cavity to the interior of the cavity.

13. A fuse assembly comprising:

a fuse body defining a cavity and opposite ends in fluid communication with the cavity;

first and second end closure elements coupled to the first end of the fuse body, each of the first and second end closure elements comprising a central opening extending therethrough and exposing a portion of cavity;

at least one fuse element situated in the cavity and electrically connected to one of the first and second end closure elements; and first and second nonconductive removable guards extending over each respective central opening in the first and second end closure elements.

14. The fuse assembly of claim 13, wherein one of the first and second end closure elements comprises a plate.

15. The fuse assembly of claim 13, wherein one of the first and second end closure elements comprises a recessed contact area surrounding the central opening.

16. A fuse assembly comprising:

a fuse body defining a cavity and opposite ends in fluid communication with the cavity;

first and second end closure elements coupled to the first end of the fuse body, each of the first and second end closure elements comprising a central opening extending therethrough and exposing a portion of cavity;

at least one fuse element situated in the cavity and electrically connected to one of the first and second end closure elements; and first and second removable guards extending over each respective central opening in the first and second end closure elements;

wherein one of the guards includes a flange portion and a plug portion extending inwardly into the cavity, the flange portion having a shape complementary to the central opening.

17. A fuse assembly comprising:

a fuse body defining a cavity and opposite ends in fluid communication with the cavity;

first and second end closure elements coupled to the first end of the fuse body, each of the first and second end closure elements comprising a central opening extending therethrough and exposing a portion of cavity;

at least one fuse element situated in the cavity and electrically connected to one of the first and second end closure elements; and first and second removable guards extending over each respective central opening in the first and second end closure elements;

wherein one of the guards includes a channel defining a flowpath extending from an exterior of the cavity to the interior of the cavity.

18. The fuse assembly of claim 13, further comprising a contact piece coupled to one of the end closure elements, the contact piece defining a contact area, one of the first and second removable guards covering the contact area.

19. The fuse assembly of claim 13, wherein the opening is non-circular.

20. The fuse assembly of claim 13, further comprising a plurality of modular end fittings of different types, the modular end fittings being separately provided from each of the first and second end closure elements, each of the modular end fittings configured to connect to the fuse assembly when the removable guards are removed.

21. The fuse assembly of claim 20, wherein each of the modular end fittings comprises a base portion and a terminal portion, the base portions of the modular end fittings configured for interchangeable mounting of the modular end fittings.

22. The fuse assembly of claim 20, wherein the plurality of modular end fittings are selected from the group of a French style fitting, a DIN style fitting, a flush mount fitting, a US style fitting, and combinations thereof.

23. A fuse assembly comprising:

a fuse body defining a cavity and opposite ends in fluid communication with the cavity;

first and second end closure elements coupled to the first end of the fuse body, each of the first and second end closure elements comprising a central opening extending therethrough and exposing a portion of cavity, the central openings of the first and second end closure elements being different from one another;

a contact piece coupled to the first end closure element the contact piece having a flange portion and a mating portion, the mating portion having a complementary shape to the central opening of the first end closure element and being insertable therein;

at least one fuse element situated in the cavity, the fuse element having first and second ends, the fuse element electrically connected to the contact piece at the first and to the second end closure element at the second end; and a plurality of interchangeable modular end fittings of different types, each of the modular end fillings configured to be interchangeably mounted to one of the contact piece and the second end closure element.

24. The fuse assembly of claim 23, wherein the plurality of modular end fittings are selected from the group of a French style fitting, a DIN style fitting, a flush mount fitting, a US style fitting, and combinations thereof.

25. The fuse assembly of claim 23, further comprising first and second removable guards extending over each respective central opening in the first and second end closure elements.

26. The fuse assembly of claim 23, wherein one of the first and second end closure elements comprises a recessed contact surface, the assembly further comprising a guard comprising a flange portion and a plug portion, the flange portion in abutting contact with the recessed contact surface.

27. The fuse assembly of claim 23, further comprising a removable guard in abutting contact with one of the first and second end closure elements, the guard defining a flowpath extending from an exterior of the cavity to the interior of the cavity.

28. A kit for assembling a fuse, the kit comprising:

a universal fuse engine comprising a body, a fuse element within the body, and opposing end closure elements, at least one of the terminal end closure elements defining an opening, and a contact piece fitted within the opening; and a plurality of interchangeable end fittings mountable to the contact piece, the plurality of end fittings comprising a standard mounting base attachable to the contact piece and different terminal configurations extending from the standard mounting base.

29. The kit of claim 28, wherein the fuse engine comprises a high speed fuse element.

30. The kit of claim 28, wherein the standard mounting base is non-circular.

31. The kit of claim 28, wherein the standard mounting base is clover shaped.

32. The kit of claim 28, further comprising a removable guard configured to removably engage the contact piece prior to installation of one of the modular end fittings.

33. The kit of claim 28, wherein the interchangeable end fittings are selected from the group of a French style fitting, a DIN style fitting, a flush mount fitting, a US style fitting, and combinations thereof.

34. The kit of claim 28, wherein the universal fuse engine comprises opposite end closure elements coupled to the body, the fuse element extending between one of the end closure elements and the contact piece.

35. A method of assembling a fuse from an inventory of components including at least one universal fuse engine and a plurality of separately provided modular end fittings of different configurations, the universal fuse engine provided with removable guards attached to end closure elements, the method comprising:

removing the guards from the fuse engine;

selecting a first and second end fitting from the plurality of modular end fittings of different configurations; and mounting the first and second end fittings to the fuse engine where the guards were installed prior to removal.

36. The method of claim 35, wherein selecting the first and second end fittings comprises selecting the first and second end fittings from the group of a French style fitting, a DIN style fitting, a flush mount fitting, a US style fitting, and combinations thereof.

37. The method of claim 35 wherein removing the guards comprises removing the guards at a location separate from a manufacturing facility for the fuse engine.

38. The method of claim 35, further comprising:

maintaining an inventory of substantially identical universal fuse engines;

maintaining an inventory of the modular end fittings;

receiving a customer order for a replacement fuse; and selecting the first and second end fittings to fill the order; and providing one of the universal fuse engines and the selected modular end fittings to the customer.

39. A modular fuse system comprising:

a plurality of modular end fittings each respectively having a mounting base and a terminal configuration extending from the mounting base, wherein the mounting bases of the plurality of the modular end fittings are substantially the same and the terminal configurations are substantially different; and a universal fuse engine, separately provided from the modular end fittings, configured to accept the mounting base of any of the modular end fittings.

40. The system of claim 39, wherein the universal fuse engine comprises a body, a fuse element within the body, and end closure elements, wherein the mounting bases are attachable to the end closure elements.

41. The system of claim 39, wherein the universal fuse engine includes a high speed fuse element.

42. A modular fuse system comprising:

means for packaging operative components of a fuse into a stand alone assembly for shipping and transit;

removable means for protecting an area of the stand alone assembly; and means for connecting the means for packaging to a circuit, the means for connecting providing a variety of connecting options for the means for packaging, the means for connecting being separately provided from the means for packaging and being interchangeably used with the means for packaging, the means for connecting occupying the same area as the means for protecting after the means for protecting is removed.

* * * * *